US010294789B2

(12) United States Patent
Krittian et al.

(10) Patent No.: US 10,294,789 B2
(45) Date of Patent: May 21, 2019

(54) HYDROSTATIC AXIAL PISTON MACHINE

(71) Applicant: Linde Hydraulics GmbH & Co. KG, Aschaffenburg (DE)

(72) Inventors: Lukas Krittian, Aschaffenburg (DE); Martin Bergmann, Schaafheim (DE)

(73) Assignee: Linde Hydraulics GmbH & Co. KG, Aschaffenburg (DE)

( * ) Notice: Subject to any disclaimer, the term of this patent is extended or adjusted under 35 U.S.C. 154(b) by 271 days.

(21) Appl. No.: 14/483,287

(22) Filed: Sep. 11, 2014

(65) Prior Publication Data

US 2015/0128796 A1 May 14, 2015

(30) Foreign Application Priority Data

Sep. 24, 2013 (DE) ..... 10 2013 110 554

(51) Int. Cl.

| | |
|---|---|
| ***F01B 3/00*** | (2006.01) |
| ***F02N 7/00*** | (2006.01) |
| ***F04B 1/20*** | (2006.01) |

(52) U.S. Cl.

CPC ..... *F01B 3/0058* (2013.01); *F01B 3/0047* (2013.01); *F04B 1/20* (2013.01); *F04B 1/2021* (2013.01); *F02N 7/00* (2013.01); *F04B 1/2035* (2013.01)

(58) Field of Classification Search

CPC ..... F04B 1/20; F04B 1/205; F04B 1/2021; F04B 1/2035; F01B 3/0058; F01B 3/0047; F01B 13/04; F02N 7/00

USPC ..... 91/499, 500, 504, 505

See application file for complete search history.

(56) References Cited

U.S. PATENT DOCUMENTS 3,106,057 A * 10/1963 Manning ..... F02N 7/08 417/222.1

4,437,389 A * 3/1984 Kline ..... F01B 3/0032 91/499

FOREIGN PATENT DOCUMENTS

| | | | |
|---|---|---|---|
| CN | 1222655 | A | 7/1999 |
| CN | 1598305 | A | 3/2005 |
| DE | 102009039828 | A1 | 3/2011 |
| DE | 102009039829 | A1 | 3/2011 |
| DE | 102011053645 | A1 | 3/2013 |

(Continued)

*Primary Examiner* — Alexander B Comley

(74) *Attorney, Agent, or Firm* — The Webb Law Firm

(57) ABSTRACT

A hydrostatic axial piston machine (1) with a cylinder barrel (2) having at least one piston bore (3) in which is located a power unit piston (4) supported on a cam disk (18). A control surface (5) is stationary relative to the housing and is on a control base (6), against which control surface the cylinder barrel (2) is in contact. In the control base (6) there are a kidney-shaped inlet connection (8) and a kidney-shaped outlet connection (9). The sealing web surface on the control surface 5 on the control base (6) in the vicinity of the inlet connection (8) is reduced, so that in operation as a motor, when there is a pressurization of the inlet connection (8), a reduction of the hydrostatic relief force is achieved. In operation as a motor, a residual application of the cylinder barrel (2) against the control surface (5) from a hold-down force of a hold-down spring (24) that is in an operative connection with the cylinder barrel (2) and/or pressing cylinder compression forces is preserved. In addition or alternatively, the terminal areas of the kidney-shaped inlet connection (8) of the control base (6) have a transitional contour (K) in the shape of a flattened arc in the radially outer area.

13 Claims, 5 Drawing Sheets

(56) References Cited

FOREIGN PATENT DOCUMENTS

| | | | |
|---|---|---|---|
| EP | 2308795 | A1 | 4/2011 |
| JP | 2000356183 | A | 12/2000 |

* cited by examiner

HYDROSTATIC AXIAL PISTON MACHINE

CROSS REFERENCE TO RELATED APPLICATION

This application claims priority to German Application No. DE 102013110554.8 filed Sep. 24, 2013, which is herein incorporated by reference in its entirety.

BACKGROUND OF THE INVENTION

Field of the Invention

This invention relates to a hydrostatic axial piston machine with a cylinder barrel located so that it can rotate around an axis of rotation, in which cylinder barrel there is at least one piston bore in which a power unit piston supported on a cam disk is located so that the piston can be displaced longitudinally. The cylinder barrel is in contact with a control surface which is stationary relative to the housing and is formed on a control base. A kidney-shaped inlet connection and a kidney-shaped outlet connection are located in the control base. During rotation of the cylinder barrel around the axis of rotation, a displacement chamber formed between the piston bore and the power unit piston is alternately placed in communication with the inlet connection and the outlet connection. The axial piston machine can be operated as a pump and as a motor in the same direction of rotation of the cylinder barrel and the same direction of flow of the hydraulic fluid. When the axial piston machine is operated as a pump with a driven cylinder barrel it takes in hydraulic fluid via the inlet connection and delivers it into the outlet connection. When the axial piston machine is operated as a motor, it is driven by hydraulic fluid under pressure supplied via the input connection.

Description of Related Art

Axial piston machines which can be operated as a pump and as a motor in the same direction of rotation of the cylinder barrel and the same direction of flow of the hydraulic fluid are operated in an open loop and can be used in mobile machines. In operation as a pump, in which the axial piston machine takes in hydraulic fluid via the input connection from a reservoir and delivers it into a delivery line connected to the outlet connection, the axial piston machine is used to supply at least one consumer, such as the consumers of the working hydraulics of the machine. If the axial piston machine is pressurized at the inlet connection with hydraulic fluid under pressure, for example, from a hydraulic accumulator, the axial piston machine functions as a motor in the same direction of rotation of the cylinder barrel and in the same direction of flow of the hydraulic fluid, which makes it possible to start a drive motor, such as an internal combustion engine, which is in a drive connection with the axial piston machine as part of a start-stop function and/or to boost the drive motor by the output of an additional torque by functioning as a booster drive.

A drive system with an axial piston machine in a drive connection with an internal combustion engine when functioning as a pump can be used to supply the consumers of working hydraulics and when functioning as a motor can be used as a hydraulic starter to start the internal combustion engine and/or as a booster drive for the internal combustion engine is known from EP 2 308 795 A1. When operating as a pump, the axial piston machine is driven by the internal combustion engine and takes in hydraulic fluid via the inlet connection from a reservoir, which is delivered via an outlet connection to the consumers of the working hydraulics. The drive system also comprises a hydraulic accumulator which, when the axial piston machine is operated as a pump, can be filled and charged with hydraulic fluid by a charging circuit. When the axial piston machine is operated as a motor, it is driven by hydraulic fluid from the hydraulic accumulator, which can be placed in communication via a discharging circuit with the inlet connection, so that the axial piston machine functions in the same direction of rotation of the cylinder barrel and the same direction of flow of the hydraulic fluid as a motor which generates a torque on the crankshaft of the internal combustion engine.

Axial piston machines operated in an open loop are optimized for operation as a pump. To achieve the highest possible suction speeds of the axial piston machine when it is operated as a pump, the suction channel connected with the inlet connection at the control surface of the control base is provided with large flow cross-sections and the kidney-shaped inlet connection in the control base is provided with a large flow cross-section. The outlet connection in the control base and the delivery channel in communication with the outlet connection is provided with smaller flow cross-sections on account of the delivery pressures to limit the material stresses in the control base, which are a function of the delivery pressure. As a rule, the kidney-shaped outlet connection is also interrupted by a plurality of webs to reduce stresses and deformations on the control base in the vicinity of the outlet connection during operation as a pump.

If an axial piston machine optimized for operation as a pump, and in which the inlet connection in the control base is provided with a flow cross-section which is larger than the outlet connection in the control base, hydraulic fluid under pressure is delivered to the inlet connection for operation as a motor by placing the inlet connection in communication with a hydraulic accumulator, to transmit, in operation as a motor, a torque to a crankshaft of the internal combustion engine which is in a drive connection with the axial piston machine, a large pressure field is created in the vicinity of the inlet connection in a constructively required gap between the control surface provided with the kidney-shaped inlet connection and the end surface of the cylinder barrel which is in contact with the control surface of the control base. The pressure field, with a correspondingly high pressure at the inlet connection, causes a lifting up of the cylinder barrel from the control surface which cannot be prevented by a hold-down spring which is normally present in the axial piston machine and which presses the cylinder barrel against the control surface. To prevent a lifting up of the cylinder barrel from the control surface when the axial piston machine is operated as a motor, hydraulic fluid at only a limited pressure can be delivered to the inlet connection of the axial piston machine which is optimized for pump operation but is being operated as a motor, as a result of which the efficiency and the torque generated by the axial piston machine are severely restricted when it is operated as a motor.

In hydrostatic axial piston machines designed for operation as a pump, which are operated in an open loop, the terminal areas of the kidney-shaped inlet connection in the control base are semicircular and are rounded by corresponding small radii to achieve a large flow cross-section of the inlet connection. When the axial piston machine is operated as a motor, in which hydraulic fluid under pressure is delivered to the inlet connection, by placing the inlet connection in communication with a hydraulic accumulator, due to the pressure present in the inlet connection, forces are exerted on the cylindrical surfaces of the inlet connection in the control base that can exceed the allowable stresses in the material of the control base in the terminal areas of the kidney-shaped inlet connection and can lead to a destruction of the control base.

Therefore, it is an object of this invention to provide axial piston machines of the general type described above but which, when operated as a motor, can be operated at an elevated pressure at the inlet connection, and when operated as a motor can deliver a high torque.

SUMMARY OF THE INVENTION

The invention accomplishes this object by reducing the surface area of the sealing web formed on the control surface located on the control base in the vicinity of the inlet connection. In motor operation, when there is a pressurization of the inlet connection, a reduction of the hydrostatic relief force can be achieved. When the axial piston machine is operated as a motor, a residual application of the cylinder barrel against the control surface from a hold-down force of a hold-down spring that is in an operative connection with the cylinder barrel, and/or the applied cylinder pressure forces is preserved. In addition or alternatively the terminal areas of the kidney-shaped inlet connection of the control base in the radially outer area have a transitional contour in the form of a flattened arc.

As a result of the constructive design of the control base and the reduction of the surface area of the sealing web of the control surface in the vicinity of the inlet connection, when the axial piston machine is operated as a motor, the hydrostatic relief force resulting from the pressure present on the sealing web surface of the inlet connection in the sealing gap between the control surface of the control base and the end surface of the cylinder barrel is reduced. By an appropriate sizing of the sealing web surface on the inlet connection, it thereby becomes possible, during operation of the axial piston machine as a motor at a pressure present in the inlet connection, to preserve a residual hold-down force of the cylinder barrel and to prevent a lifting up of the cylinder barrel from the control surface. When the axial piston machine of the invention is operated as a motor with a pressure present in the inlet connection, a residual application pressure of the cylinder barrel is preserved and a lifting up of the cylinder barrel from the control surface is prevented. Therefore, during operation as a motor it is prevented, that hydraulic fluid escapes into the interior of the housing, which is connected with a tank, without generating a torque.

As a result of the constructive design of the terminal areas of the kidney-shaped inlet connection of the control base in the radially outer portion with a transitional contour that is in the form of a flattened arc, the rounding of the terminal area of the kidney-shaped inlet connection formed by the transitional contour can be adapted to the stress curve that occurs in the control base during operation as a motor on account of the forces present on the cylindrical surfaces of the inlet connection resulting from the pressure in the inlet connection. On account of the transitional contour which is in the shape of a flattened arc, during operation as a motor when pressure is present in the inlet connection, the forces acting on the cylindrical surfaces of the inlet connection can be transmitted with a favorable force and stress curve, so that an improved flow of force and stress in the control base is achieved in the terminal areas of the inlet connection. The modified transitional contour in the terminal areas of the kidney-shaped inlet connection leads to only a slight reduction of the flow cross-section of the inlet connection, so that there are little or no negative effects on the suction speed when the axial piston machine is operated as a pump.

Overall, as a result of the constructive design and sizing of the sealing web surfaces of the control base of the invention, it becomes possible to operate the axial piston machine as a motor with an increased pressure level at the inlet connection without the cylinder barrel lifting up from the control surface, so that the axial piston machine being operated as a motor can output an increased torque to the drive shaft. Furthermore, as a result of the constructive design of the terminal area of the kidney-shaped inlet connection, even at an increased pressure level at the inlet connection during operation as a motor, the risk of damage and destruction of the control base is eliminated. The modified design of the terminal area of the kidney-shaped inlet connection does not lead to negative effects on the suction speed of the axial piston machine during operation as a pump.

In one embodiment of the invention, the control base is provided in the vicinity of the control surface with a uniform outside diameter and a uniform inside diameter and the reduction of the sealing web surface area in the vicinity of the inlet connection is achieved by a widening of the kidney-shaped inlet connection. On a control base which is provided with a uniform outside diameter or inside diameter on the control surface, and therefore, the boundaries of the sealing web formed by the outside diameter and the inside diameter form circular sealing web boundaries, by an appropriate choice and coordination of the width of the kidney-shaped inlet connection, a corresponding reduction of the sealing web surface area on the inlet connection can be achieved, which results in the desired reduction of the hydrostatic relief force during operation as a motor, to prevent the cylinder barrel from lifting up from the control surface even when a high pressure level is present at the inlet connection.

In one alternative embodiment of the invention, to reduce the sealing web surface in the vicinity of the inlet connection, the control base is provided with at least one cutout in the control surface. By means of corresponding cutouts, which can be distributed over the periphery of the control surface of the control base, it also becomes possible to reduce the sealing web surface area at the inlet connection so that during operation as a motor, a reduction of the hydrostatic relief force is achieved and the cylinder barrel is prevented from lifting up from the control surface even at a high pressure level of the pressure present at the inlet connection. Cutouts of this type can have oval or stepped geometries.

In one preferred embodiment of the invention, the control base is provided in the vicinity of the control surface with a stepped outside diameter and/or a stepped inside diameter. To reduce the surface area of the sealing web in the vicinity of the inlet connection, the outside diameter of the control surface at the inlet connection is smaller than the outside diameter of the control surface at the outlet connection, and/or the inside diameter of the control surface at the inlet connection is larger than the inside diameter of the control surface at the outlet connection. With an outside diameter of the control surface at the inlet connection that is smaller than the outside diameter of the control surface at the outlet connection, the outer sealing web at the inlet connection formed between the radio outer edge of the inlet connection and the outside diameter has a lower width than the corresponding outer sealing web at the outlet connection. With an inside diameter of the control surface at the inlet connection that is larger than the inside diameter of the control surface at the outlet connection, the inner sealing web at the inlet connection formed between the radial inner edge of the inlet connection and the inside diameter has a smaller width than the corresponding inner sealing web at the outlet connection. With cylindrical sealing webs, it thereby becomes possible with little extra construction effort or expense to achieve a reduction of the width of the sealing web, and thus of the surface area of the sealing web, at the inlet connection, so that during operation as a motor, there is a reduction of the hydrostatic relief force, and a lifting up of the cylinder barrel from the control surface can be prevented even at a high pressure level of the pressure present at the inlet connection.

In one advantageous embodiment of the invention, the terminal areas of the kidney-shaped outlet connection of the control base have a transitional contour in the shape of a flattened arc in the radially outer area. This measure also makes it possible to achieve a favorable force and stress curve at the outlet connection.

In one advantageous embodiment of the invention, the transitional contour in the radially outward terminal area of the kidney-shaped inlet connection, or of the kidney-shaped outlet connection adapted and optimized to the stress curve for operation as a motor, is formed by an oval contour. An oval contour can be created in the terminal area of the kidney-shaped inlet connection with little extra manufacturing effort or expense.

In one alternative embodiment of the invention, the transitional contour in the radially outer terminal area of the kidney-shaped inlet connection, or of the kidney-shaped outlet connection adapted and optimized to the stress curve for operation as a motor, is formed by a plurality of radii and/or angular sectors that transition tangentially into one another. A transitional contour in the terminal area of the inlet connection adapted to the stress curve during operation as a motor can be created by a combination of radii and angular sectors that transition tangentially into each other with little extra manufacturing effort or expense.

The invention further relates to a hydrostatic drive system with an axial piston machine of the invention which is in a drive connection with a drive motor, such as an internal combustion engine. When operated as a pump, the axial piston machine functions to supply at least one consumer, such as the working hydraulics. When operated as a motor, the axial piston machine functions as a hydraulic starter of the drive motor and/or as a booster drive. In a drive system with an axial piston machine optimized for operation as a pump to supply the working hydraulics, the input connection of which has a larger flow cross-section than the outlet connection, as a result of the constructive design of the control base of the invention, the axial piston machine operated as a motor can be operated at a high pressure at the inlet connection to generate a high torque, so that with the axial piston machine, it becomes possible with little extra construction effort or expense to create a hydraulic starter for a start-stop system of the drive motor and/or a booster drive to boost the torque of the drive motor.

The invention further relates to a mobile machine with a drive system of the invention. With the axial piston machine of the invention, it is possible with little extra construction effort or expense on a mobile machine with working hydraulics, utilizing the axial piston pump which is already present to supply the working hydraulics to achieve a more powerful and efficient hydraulic starter for a start-stop system of the drive motor.

The invention further relates to a stationary power unit with a drive system of the invention. With the axial piston machine of the invention, it becomes possible with little extra construction effort or expense on a stationary hydraulic power unit with at least one hydraulic consumer, utilizing the axial piston pump which is already present, to supply the consumer to achieve a more powerful and efficient hydraulic starter for a start-stop system of the drive motor.

BRIEF DESCRIPTION OF THE DRAWINGS

Additional advantages and details of the invention are explained in greater detail below with reference to the exemplary embodiments illustrated in the accompanying schematic figures, in which like reference numbers identify like parts throughout.

DESCRIPTION OF THE PREFERRED EMBODIMENTS

Figure 1:
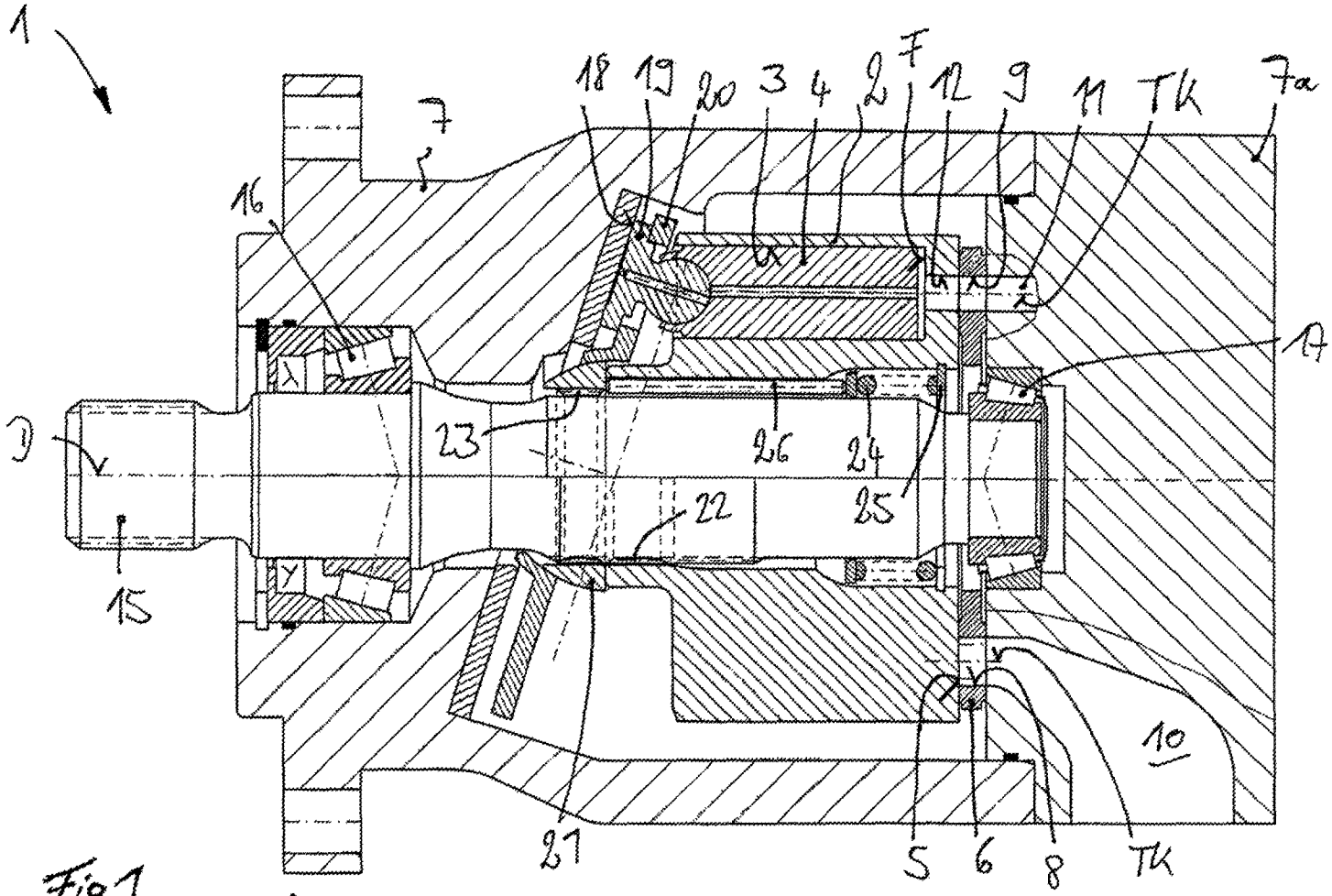
FIG. 1 shows an axial piston machine of the prior art in longitudinal section.

FIG. 1 shows, in a longitudinal section, a hydrostatic axial piston machine 1 of the prior art utilizing a swashplate construction which is operated in an open circuit and is optimized for operation as a pump.

The axial piston machine 1 has a cylinder barrel 2 that is arranged so that it can rotate around an axis of rotation D and is provided with a plurality of piston bores 3 that are concentric to the axis of rotation D and are located on a pitch circle TK. The piston bores 3 are preferably formed by cylindrical borings. A power unit piston 4 is mounted in each piston bore 3 so that it can be displaced longitudinally.

The cylinder barrel 2 is supported in the axial direction with one end face on a control surface 5 which is stationary with reference to a housing and is located on a disk-shaped control base 6 which is non-rotationally fastened to a housing 7 or to a corresponding housing cover 7*a* of the housing 7. The control base 6 is provided with kidney-shaped control slots which form an inlet connection 8 and an outlet connection 9. The inlet connection 8 is in communication with a suction channel 10 in the housing 7 or in the housing cover 7*a*. Connected to the outlet connection 9 is a delivery channel 11 in the housing 7 or in the housing cover 7*a*. The piston bores 3 are each provided on the end face of the cylinder barrel 2 with a preferably kidney-shaped connection channel 12 to place the displacement chambers formed by the power unit pistons 4 and the piston bores 3 alternately in communication with the inlet connection 8 and the outlet connection 9 during rotation of the cylinder barrel 2 around the axis of rotation D.

The cylinder barrel 2 is traversed by a central boring through which a drive shaft 15 that is concentric to the axis of rotation D is guided through the cylinder barrel 2. The drive shaft 15 is rotationally mounted in the housing 7 by bearings 16, 17. The cylinder barrel 2 is connected with the drive shaft 15 in a rotationally synchronous manner although it can move axially, for example by means of teeth 22 in the vicinity of a cylinder barrel neck of the cylinder barrel 2 which is formed onto the cylinder barrel 2 and which extends in the axial direction toward a cam disk 18.

The power unit pistons 4 are each supported in the area in which they project out of the cylinder barrel 2 by a support element which can be in the form of a slipper 19, on the cam disk 18, such as a swashplate which is inclined with respect to the axis of rotation D and generates the displacement. The cam disk 18 can be formed onto or fastened to the housing 7, in which case the axial piston machine 1 has a fixed displacement volume. It is also possible, however, to make the inclination of the cam disk 18 variable by an adjustment device, such as a pivotable cradle, in a pivoting direction, as a result of which the axial piston machine 1 has a variable displacement volume and can be adjusted unilaterally.

The support elements in the form of slippers 19 are prevented from lifting up from the cam disk 18 by a hold-down plate 20 in the form of a ring-shaped disk. The hold-down plate 20 rotates together with the cylinder barrel 2 and is pressed toward the cam disk 18 by a hold-down device 21 which is in the form of a spherical cap shaped or a concave shaped hold-down disk. The hold-down device 21 is connected with the drive shaft 15 in a rotationally synchronous manner but so that it can be displaced axially, for example by means of teeth 23. A hold-down spring 24 in the form of a compression spring is located in the space between the drive shaft 15 and the cylinder barrel 2. The hold-down spring 24 is supported on a first end by a stop 25, such as a retaining ring, on the cylinder barrel 2. On the second end, the hold-down spring 24 is connected with the hold-down device 21 by pins 26. By means of the hold-down spring 24, the cylinder barrel 2 is thereby pressed against the control surface 5 and the slippers 19 are pressed against the cam disk 18 by the hold-down device 21.

Cylinder compression forces pressing the cylinder barrel 2 down onto the control surface 5 also act on the cylinder barrel 2. The applied cylinder compression forces result from the pressure originating in the piston bores 3 and the pressurized surface F which corresponds to the difference in the cross-section surfaces of the piston bores 3 and the cross-section surface of the connection channels 12.

A gap in which a hydrostatic lubrication film can be formed is located between the cylinder barrel 2 and the control surface 5. In the gap there is a hydrostatic relief force which results from the pressure present in the gap and the surface areas of sealing webs on the control surface 5 of the control base 6.

Figure 2:
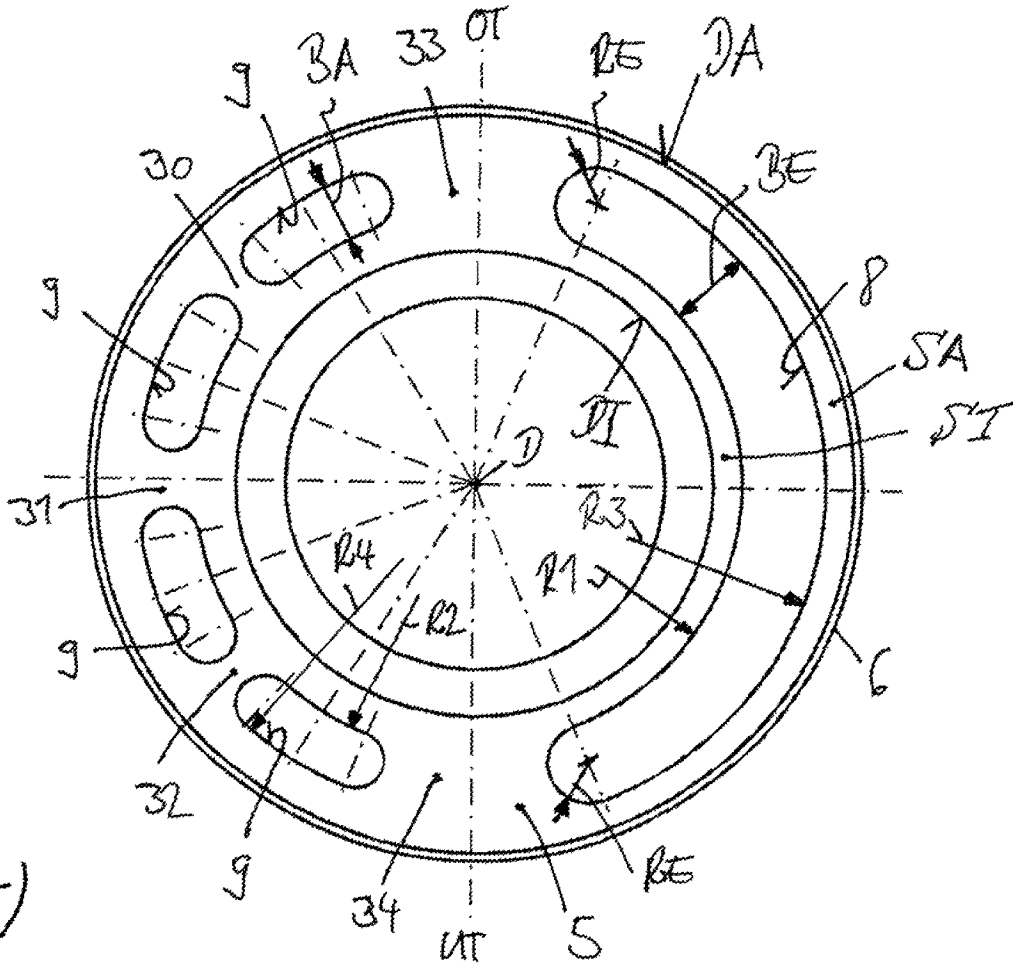
FIG. 2 is a plan view of the control surface of the control base of the axial piston machine illustrated in FIG. 1.

As shown in FIGS. 1 and 2, on the axial piston machine 1 optimized for pump operation, the suction channel 10 and the kidney-shaped inlet connection 8 in the control surface 5 have larger flow cross-sections than the delivery channel 11 and the kidney-shaped outlet connection 9. The width BE of the kidney-shaped inlet connection 8 is greater than the flow cross-section BA of the kidney-shaped outlet connection 9 (as illustrated in FIG. 2, which is a plan view of the control surface 5 of the control base 6).

The inside radius R1 of the kidney-shaped inlet connection 8 is smaller than the inside radius R2 of the kidney-shaped outlet connection 9 and the outside radius R3 of the kidney-shaped inlet connection 8 is larger than the outside radius R4 of the kidney-shaped outlet connection 9, so that the inlet connection 8 is wider than the outlet connection 9 on the inside and on the outside.

The kidney-shaped outlet connection 9 is also interrupted by a plurality of webs 30, 31, 32, to reduce the stresses and deformations in the vicinity of the delivery-side outlet connection 9, which is also pressurized at the delivery pressure during operation as a pump.

The two peripheral-side terminal areas of the kidney-shaped inlet connection 8 in the control base 6 are semi-circular and/or rounded, each with a radius RE.

The control base 6 is provided in the vicinity of the control surface 5 which is on the end surface with a uniform outside diameter DA and a uniform inside diameter DI. The area of the control surface 5 between the outer edge of the inlet connection 8 and the outside diameter DA of the control surface 5 forms a radially outer sealing web SA. The area of the control surface 5 between the inner edge of the inlet connection 8 and the inside diameter DI of the control surface 5 correspondingly forms a radially inner sealing web SI. In the vicinity of the top dead center OT and the bottom dead center UT of the movement of the power unit pistons 4, there are respective reversing areas 33, 34 on the control surface 5.

If the axial piston machine 1 is operated as a pump, the cylinder barrel 2 is driven by the drive shaft 15, for example, by a drive motor in the form of an internal combustion engine. The axial piston machine 1, when operated as a pump, sucks hydraulic fluid via the suction channel 10 and the inlet connection 8 of the control surface 5 from a reservoir and delivers the hydraulic fluid via the outlet connection 9 of the control base 6 into the delivery channel 11. The consumers of the working hydraulics of the machine that are supplied with hydraulic fluid by the axial piston machine 1 functioning as a pump are preferably connected to the delivery channel 11. On account of the design of the suction channel 10 and of the inlet connection 8 with flow cross-sections that are larger than those of the delivery channel 11 and the outlet connection 9 and the design of the outlet connection 9 with the additional webs 30, 31, 32, the axial piston machine 1 is optimized for operation as a pump, to make high suction speeds possible.

The axial piston machine 1 of the prior art can also be operated as a motor in the same direction of rotation of the cylinder barrel 2 and the same direction of flow of the hydraulic fluid. Hydraulic fluid under pressure, for example, from a hydraulic accumulator, is supplied via the suction channel 10 in the inlet connection 8 of the control base 5, and the axial piston machine 1 delivers into a reservoir via the outlet connection 9 of the control base 5 and the delivery channel 11. In this mode of operation of the axial piston machine 1 as a motor, a torque can be output by the drive shaft 15. When operated as a motor, the axial piston machine 1 can be used as a hydraulic starter for the internal combustion engine connected with the drive shaft 15 in a start-stop system and/or as a booster drive to assist the internal combustion engine.

When operated as a motor, the axial piston machine 1 of the prior art, on account of the large sealing web surface area in the vicinity of the inlet connection 8, which is formed by the cylindrical sealing webs SI and SA on the control surface 5 in the vicinity of the inlet connection 8, generates a large pressure field in the vicinity of the inlet connection 8 of the control surface 5, which at an appropriately high pressure in the inlet connection 8 results in a correspondingly high hydrostatic relief force, which in turn results in the lifting up of the cylinder barrel 2 from the control surface 5, which cannot be prevented by the hold-down spring 24 and the cylinder compression forces.

In addition, when the axial piston machine 1 of the prior art is operated as a motor, forces from the pressure present in the inlet connection 8 are acting on the cylinder surfaces of the inlet connection 8 in the control base 6, which forces can exceed the allowable stresses in the material in the terminal areas of the inlet connection 8 characterized by the radii RE and lead to a destruction of the control base 6. It has been shown that the radially outer areas of the semicircular rounded terminal areas of the inlet connection 8 lead to an unfavorable stress curve with high material stresses in the control base 6.

Figure 3:
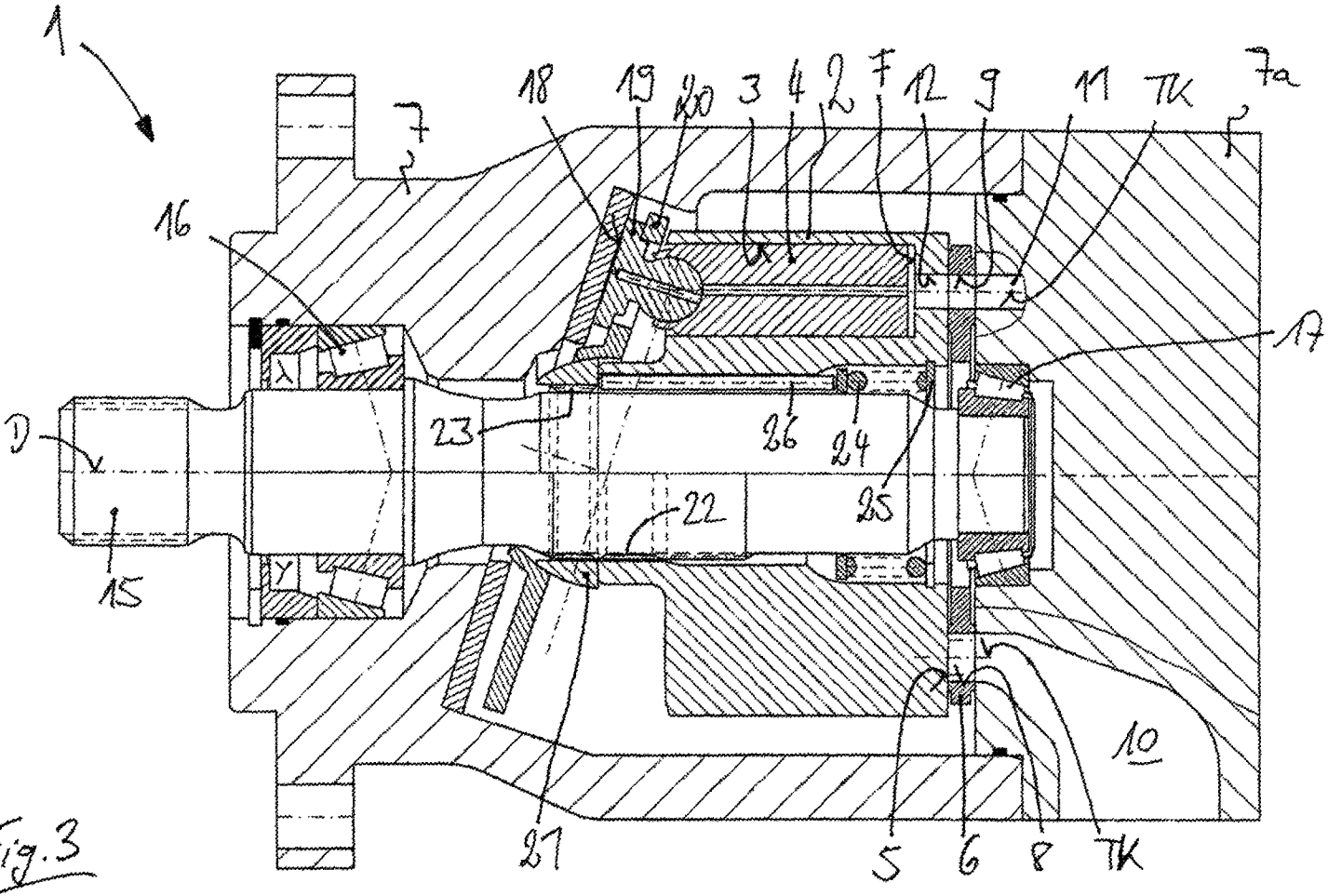
FIG. 3 shows an axial piston machine of the invention in a longitudinal section.
Figure 4:
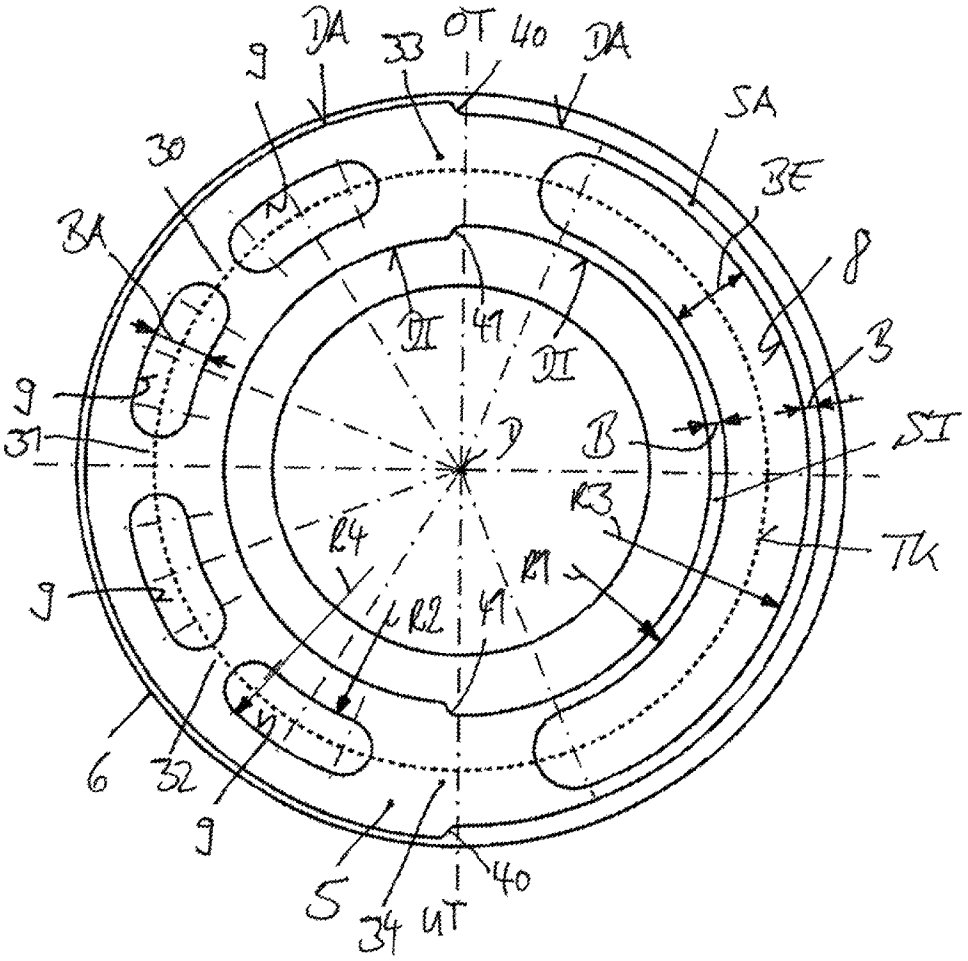
FIG. 4 is a plan view of the control surface of the control base of the axial piston machine illustrated in FIG. 3.
Figure 5:
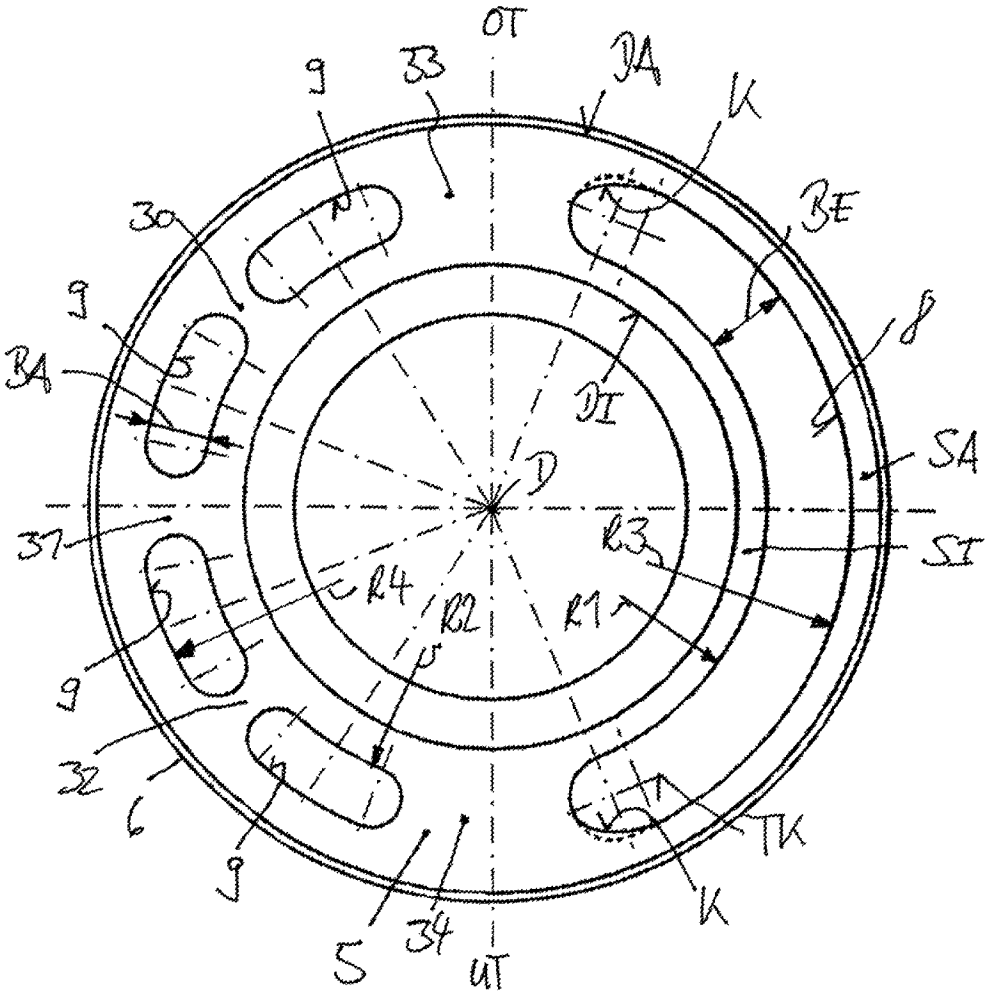
FIG. 5 is a plan view of the control surface of a second embodiment of the control base of the axial piston machine illustrated in FIG. 3.

FIGS. 3 to 5 illustrate an axial piston machine 1 of the invention.

As illustrated in FIG. 4, on the control surface 5 of the control base 6 in the vicinity of the inlet connection 8, the sealing web surface area formed by the radially inner sealing web SI and the radially outer sealing web SA is smaller than the prior art embodiment illustrated in FIG. 2.

The sealing webs SI and SA on the inlet connection 8 are cylindrical sealing webs. To make the surface areas of the sealing webs SI and SA on the inlet connection 8 smaller than those in FIG. 2, the control base 6 is provided in the vicinity of the control surface 5 with a stepped outside diameter DA and a stepped inside diameter DI. To reduce the surface area of the sealing webs in the vicinity of the inlet connection 8, the outside diameter DA of the control surface 5 on the inlet connection 8 is smaller than the outside diameter DA of the control surface 5 on the outlet connection 9. Accordingly, the inside diameter DI of the control surface 5 on the inlet connection 8 is greater than the inside diameter DI of the control surface 5 on the outlet connection 9. The diameter transitions 40, 41 on the inside diameter DI and on the outside diameter DA, with reference to the dead center points OT, UT, are located on the geometric half plane that contains the outlet connection 9.

With this design of the control base 6 and the width B of the cylindrical sealing webs SI, SA, which is less than that indicated in FIG. 2 on account of the stepped outside diameter DA and the stepped inside diameter DI, a reduction of the surface area of the sealing web on the control surface 5 on the inlet connection 8 is achieved, so that during operation as a motor, a reduction of the hydrostatic relief force is achieved when the inlet connection 8 is pressurized. The sealing web surface area on the inlet connection 8 is selected so that when the axial piston machine 1 is operated as a motor, even at an elevated pressure level of the pressure in the inlet connection 8, the sum of the relieving forces does not exceed the hold-down forces applied, so that a residual pressing of the cylinder barrel 2 against the control surface 5 from the hold-down force applied by the hold-down spring 24 that is in an operative connection with the cylinder barrel 2 and the applied cylinder compression forces is preserved and thus the cylinder barrel 2 is prevented from lifting up from the control surface 5.

The construction of the control base 6 illustrated in FIG. 4 makes it possible, on account of the widths B of the inner sealing web SI and of the outer sealing web SA which are each adapted to the inlet connection 8 and the outlet connection 9 respectively, to achieve an optimal hydrostatic relief for both pump operation as well as for motor operation of the axial piston machine 1.

As a result of the reduction of the sealing web surface area on the inlet connection 8, the axial piston machine 1 of the invention can also be operated, in contrast to the axial piston machine of the prior art illustrated in FIGS. 1 and 2 which are optimized for operation as a pump, at an elevated and increased pressure level at the inlet connection 8 in operation as a motor, so that the axial piston machine 1 of the invention, when operated as a motor, can output an elevated torque on the drive shaft 15.

As a result of the corresponding adaptation and size of the sealing webs SI, SA, a defined residual hold-down pressure of the cylinder barrel 2 can be set for both motor operation as well as for pump operation of the axial piston machine of the invention, which makes low friction losses possible.

FIG. 5 illustrates a control base 6 of an axial piston machine 1 of the invention in which an additional measure is implemented to increase the pressure level present at the inlet connection 8 when the axial piston machine is operated as a motor.

The peripheral-side terminal areas of the kidney-shaped inlet connection 8 of the control base 6 are provided in the half that lies in the radial direction outside the pitch circle TK, and, thus, in the radially outer area, with a transitional contour K which is in the shape of a flattened arc. In FIG. 5, the transitional contours K of the invention are drawn in solid lines. The terminal areas of the control base 6 of the prior art formed by an arc, which are formed by a radius RE in FIG. 2, are drawn in broken lines to more clearly illustrate the invention.

In the exemplary embodiment illustrated in FIG. 5, the transitional contours K on the radially outer terminal area of the kidney-shaped inlet connection 8 are each formed by an oval contour and, thus, an oval geometry.

The transitional contours K on the radially outer terminal area of the kidney-shaped inlet connection 8 make it possible to adapt the external contour of the inlet connection 8 in the terminal areas to the resulting stress curve during operation as a motor. On account of the transitional contours K adapted to the stress curve on the radially outer terminal areas of the inlet connection 8, the pressure level for operation of the axial piston machine 1 of the invention as a motor can be increased compared to the axial piston machine of the prior art optimized for operation as a pump illustrated in FIGS. 1 and 2, so that an increased drive torque is available on the drive shaft 15 without damaging the control base 6. The constructive design of the transitional contours K of the invention makes it possible, when the axial piston machine 1 is operated as a motor, to advantageously absorb the stresses and forces in the material of the control base 6 in spite of the increased pressure level in the inlet connection 8. The transitional contours K on the radially outer terminal area of the kidney-shaped inlet connection 8 result in only a slight reduction of the flow cross-section of the inlet connection 8, so that on account of the geometry of the inlet connection 8, which is optimized in terms of stress for operation as a motor, there is no adverse effect on the suction capacity and the suction limit speed of the axial piston machine 1 when it is operated as a pump.

The invention is not restricted to the exemplary embodiments illustrated in FIGS. 4 and 5, in which the measures in FIGS. 4 and 5 are implemented separately and individually to increase the pressure level when operated as a motor. It goes without saying that both measures can be implemented jointly on an axial piston machine 1 of the invention to increase the pressure in motor operation as illustrated in FIGS. 4 and 5.

With the geometry and constructive design of the control base 6 adapted for the operation of the axial piston machine 1 as a motor, by means of a corresponding design of the sealing web services on the inlet connection 8 and/or a corresponding design of the peripheral-side terminal areas of the inlet connection 8 on an axial piston machine 1 operated in an open loop, the pressure present at the inlet connection 8 can be increased, so that the axial piston machine 1 can output a torque sufficient to start an internal combustion engine which is in a drive connection with the axial piston machine 1. Therefore, on a mobile machine, an axial piston machine 1 in the form of a pump which is already present to supply the consumers of the working hydraulics can be used as a hydraulic starter for a start-stop system of the internal combustion engine.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A hydrostatic axial piston machine, comprising:

a cylinder barrel rotatable around an axis of rotation;

at least one piston bore located in the cylinder barrel;

a power unit piston located in the at least one piston bore and supported on a cam disk so that it can move longitudinally;

a control surface stationary relative to a housing and located on a control base, against which an end face surface of the cylinder barrel is in contact;

a kidney-shaped inlet connection formed in a first half of the control base and a kidney-shaped outlet connection formed in a second half of the control base; and a displacement chamber formed between the at least one piston bore and the power unit piston, which during rotation of the cylinder barrel around the axis of rotation is placed in communication alternately with the inlet connection and the outlet connection, wherein the axial piston machine is operable as a pump and as a motor in a same direction of rotation of the cylinder barrel and a same direction of flow of hydraulic fluid, wherein when the cylinder barrel is driven in pump operation, the axial piston machine takes in hydraulic fluid via the inlet connection and delivers it into the outlet connection, wherein when operated as a motor, the axial piston machine is driven by hydraulic fluid under pressure delivered by the inlet connection, wherein a sealing web surface on the control surface on the control base in a vicinity of the inlet connection is smaller than a sealing web surface on the control surface of the control base in a vicinity of the outlet connection, so that in operation as a motor, when there is a pressurization of the inlet connection, a reduction of a hydrostatic relief force is achieved, and so that, in operation as a motor, a residual application of the cylinder barrel against the control surface from a hold-down force of a hold-down spring that is in an operative connection with the cylinder barrel or pressing cylinder compression forces is preserved, and wherein the first half of the control surface of the control base has a single outside diameter and a single inside diameter, wherein the second half of the control surface of the control base has an outside diameter and an inside diameter, wherein the single outside diameter of the control surface of the first half of the control base is smaller than the outside diameter of the control surface on the second half of the control base and/or the single inside diameter of the control surface on the first half of the control base is larger than the inside diameter of the control surface on the second half of the control base.

2. The hydrostatic axial piston machine as recited in claim 1, wherein the control base includes at least one cutout in the control surface to reduce the sealing web surface area in the vicinity of the inlet connection.

3. The hydrostatic axial piston machine as recited in claim 2, wherein terminal areas of the kidney-shaped outlet connection of the control base or terminal areas of the kidney-shaped inlet connection of the control base at a radially outer region have a transitional contour that is flattened.

4. The hydrostatic axial piston machine as recited in claim 2, wherein a transitional contour in a radially outer terminal area of the kidney-shaped inlet connection or of the kidney-shaped outlet connection is formed by an oval contour.

5. The hydrostatic axial piston machine as recited in claim 1, wherein the control base includes in the vicinity of the control surface a stepped outside diameter and/or a stepped inside diameter within the second half of the control base.

6. The hydrostatic axial piston machine as recited in claim 5, wherein terminal areas of the kidney-shaped outlet connection of the control base or terminal areas of the kidney-shaped inlet connection of the control base at a radially outer region have a transitional contour that is flattened.

7. The hydrostatic axial piston machine as recited in claim 5, wherein a transitional contour in the radially outer terminal area of the kidney-shaped inlet connection or of the kidney-shaped outlet connection is formed by an oval contour.

8. The hydrostatic axial piston machine as recited in claim 1, wherein terminal areas of the kidney-shaped outlet connection of the control base or terminal areas of the kidney-shaped inlet connection of the control base at a radially outer region have a transitional contour that is flattened.

9. The hydrostatic axial piston machine as recited the claim 1, wherein a transitional contour in a radially outer terminal area of the kidney-shaped inlet connection or of the kidney-shaped outlet connection is formed by an oval contour.

10. A hydrostatic drive system with a hydrostatic axial piston machine, the axial piston machine comprising:

a cylinder barrel rotatable around an axis of rotation;

at least one piston bore located in the cylinder barrel;

a power unit piston located in the at least one piston bore and supported on a cam disk so that it can move longitudinally;

a control surface stationary relative to a housing and located on a control base, against which an end face surface of the cylinder barrel is in contact;

a kidney-shaped inlet connection formed in a first half of the control base and a kidney-shaped outlet connection formed in a second half of the control base;

a displacement chamber formed between the at least one piston bore and the power unit piston, which during rotation of the cylinder barrel around the axis of rotation is placed in communication alternately with the inlet connection and the outlet connection, wherein the axial piston machine is operable as a pump and as a motor in a same direction of rotation of the cylinder barrel and a same direction of flow of hydraulic fluid, wherein when the cylinder barrel is driven in pump operation, the axial piston machine takes in hydraulic fluid via the inlet connection and delivers it into the outlet connection, wherein when operated as a motor, the axial piston machine is driven by hydraulic fluid under pressure delivered by the inlet connection, wherein a sealing web surface on the control surface of the control base in a vicinity of the inlet connection is smaller than a sealing web surface on the control surface on the control base in a vicinity of the outlet connection, so that in operation as a motor, when there is a pressurization of the inlet connection, a reduction of a hydrostatic relief force is achieved, and so that, in operation as a motor, a residual application of the cylinder barrel against the control surface from a hold-down force of a hold-down spring that is in an operative connection with the cylinder barrel or pressing cylinder compression forces is preserved; and a drive motor comprising an internal combustion engine, wherein the axial piston machine is in drive connection with the drive motor, wherein the axial piston machine, when operated as a pump, supplies at least one consumer, and when operated as a motor functions as a hydraulic starter of the drive motor and/or as a booster drive, and wherein the first half of the control surface of the control base has a single outside diameter and a single inside diameter, wherein the second half of the control surface of the control base has an outside diameter and an inside diameter, wherein the single outside diameter of the control surface of the first half of the control base is smaller than the outside diameter of the control surface on the second half of the control base and/or the single inside diameter of the control surface on the first half of the control base is larger than the inside diameter of the control surface on the second half of the control base.

11. A mobile machine comprising a drive system as recited in claim 10.

12. A stationary power unit with a drive system as recited in claim 10.

13. A hydrostatic axial piston machine, comprising:

a cylinder barrel rotatable around an axis of rotation;

at least one piston bore located in the cylinder barrel;

a power unit piston located in the at least one piston bore and supported on a cam disk so that it can move longitudinally;

a control surface stationary relative to a housing and located on a control base, against which an end face surface of the cylinder barrel is in contact;

a kidney-shaped inlet connection formed in a first half of the control base and a kidney-shaped outlet connection formed in a second half of the control base; and a displacement chamber formed between the at least one piston bore and the power unit piston, which during rotation of the cylinder barrel around the axis of rotation is placed in communication alternately with the inlet connection and the outlet connection, wherein the axial piston machine is operable as a pump and as a motor in a same direction of rotation of the cylinder barrel and a same direction of flow of hydraulic fluid, wherein when the cylinder barrel is driven in pump operation, the axial piston machine takes in hydraulic fluid via the inlet connection and delivers it into the outlet connection, wherein when operated as a motor, the axial piston machine is driven by hydraulic fluid under pressure delivered by the inlet connection, wherein a sealing web surface on the control surface of the control base in a vicinity of the inlet connection is smaller than a sealing web surface on the control surface on the control base in a vicinity of the outlet connection, so that in operation as a motor, when there is a pressurization of the inlet connection, a reduction of a hydrostatic relief force is achieved, and so that, in operation as a motor, a residual application of the cylinder barrel against the control surface from a hold-down force of a hold-down spring that is in an operative connection with the cylinder barrel or pressing cylinder compression forces is preserved, wherein terminal areas of the kidney-shaped inlet connection of the control base at a radially outer region have a transitional contour that is flattened, and wherein the first half of the control surface of the control base has a single outside diameter and a single inside diameter, wherein the second half of the control surface of the control base has an outside diameter and an inside diameter, wherein the single outside diameter of the control surface of the first half of the control base is smaller than the outside diameter of the control surface on the second half of the control base and/or the single inside diameter of the control surface on the first half of the control base is larger than the inside diameter of the control surface on the second half of the control base.

* * * * *